United States Patent [19]

Seats et al.

[11] 4,432,464

[45] Feb. 21, 1984

[54] LARGE METAL CONE CATHODE RAY TUBES, AND ENVELOPES THEREFOR

[75] Inventors: Peter Seats, Boonton; Emil Sanford, Montclair; Bernard M. Waxenbaum, Paramus, all of N.J.

[73] Assignee: Thomas Electronics, Inc., Wayne, N.J.

[21] Appl. No.: 300,682

[22] Filed: Sep. 9, 1981

[51] Int. Cl.[3] ..... H01J 31/00; H01J 61/30

[52] U.S. Cl. ..... 220/2.1 A; 65/42; 313/364

[58] Field of Search ..... 220/2.1 A, 2.1 R, 2.3 A, 220/2.3 R; 65/40, 42, 55, 58, 107; 313/402–408, 364, 477 R, 102; 403/270; 250/213 UT

[56] References Cited

U.S. PATENT DOCUMENTS

| | | | |
|---|---|---|---|
| 2,562,163 | 7/1951 | Hiensch et al. | 220/2.1 A |
| 2,603,177 | 7/1952 | Gardiner | 220/2.3 A |
| 2,722,085 | 11/1955 | De Gier et al. | 220/2.3 A |
| 2,764,810 | 10/1956 | Gardiner | 220/2.3 A |
| 2,793,311 | 5/1957 | Thomas | 220/2.3 A |
| 2,821,811 | 2/1958 | Hagenberg | 220/2.3 A |
| 2,836,751 | 5/1958 | Turnbull et al. | 220/2.3 A |
| 2,975,313 | 3/1961 | Jacobs | 220/2.3 A |
| 3,061,664 | 10/1962 | Kegg | 220/2.1 R |
| 3,113,878 | 12/1963 | Martin | 220/2.1 A |
| 4,238,043 | 12/1980 | Minami et al. | 220/2.1 R |

OTHER PUBLICATIONS

Development of a Large Metal Kinescope for Television by Steier, Lattimer and Faulkner.

*Primary Examiner*—Allan N. Shoap
*Assistant Examiner*—Robert Petrik
*Attorney, Agent, or Firm*—Davis, Hoxie, Faithfull & Hapgood

[57] ABSTRACT

A large metal cone cathode ray tube and envelope for the same in which the faceplate is adhered to the metal cone by a frit seal without distorting the faceplate. In some embodiments, a glass neck assembly also is adhered to the metal cone by a frit seal. Readily available glass and metal materials can be used.

18 Claims, 5 Drawing Figures

LARGE METAL CONE CATHODE RAY TUBES, AND ENVELOPES THEREFOR

FIELD OF THE INVENTION

This invention relates to large metal cone cathode ray tubes and envelopes for the same.

BACKGROUND OF THE INVENTION

In the early period of commercialization of television, the use of metal cones made large diameter cathode ray tubes (CRT's) practical. The first such tube, type 16AP4, was announced in 1948. Its development is described in the article by H. P. Steier et al., "Development of a Large Metal Kinescope for Television", *RCA Review,* March 1949, reprinted in *Television*, Vol VI (1950). In such tubes, a truncated metal cone formed the major section of the envelope. A glass faceplate was attached by a high temperature, glass-to-metal seal to a lip at the large end of the cone and a bell shaped glass similarly attached to the smaller end of the metal cone.

Improvements in mass production techniques resulted in large all glass CRT envelopes being produced at lower prices than metal cone types. Consequently, the use of metal cone CRT's as picture tubes in the television industry was discontinued. The use of specially designed metal cone CRT's continued on a small scale for use in radar displays. In these display tubes it is desireable that the faceplate be essentially flat in order to allow the use of mechanical markers on or directly above the surface of the horizontally mounted glass faceplate to provide radar operators with the means to indicate the location of radar targets. It was found that metal cone bulb technology of the traditional type was suitable for production of large envelope CRT's with essentially flat faceplates, without the major tooling and design problems associated with all glass, substantially flat faceplate envelopes.

Until my invention, the selection criteria for the metal alloy used for a metal cone CRT envelope has been determined by properties deemed desireable for a direct, high temperature glass-to-metal seal between the metal cone and glass faceplate. Chrome-bearing alloys have been the material of choice for such metal CRT cones for the past thirty years, usually of the type S.A.E. 446 or 430, although these alloys are relatively difficult to form into the desired shape. The faceplate glass used with these alloys for large diameter cones was a special glass selected to have an expansion coefficient of approximately $95\times10^{-7}$ per °C. in order to match the metal's properties.

In the early days of picture tube development, many types of sheet and plate glasses were available with various properties. Consequently, one could generally select a glass for a particular sealing design without difficulty. In recent years, however, flat glass is now produced on a worldwide scale almost entirely by the "Float" process developed by Pilkington Brothers Limited in the UK. Since the Float process is superior to other methods of producing flat glass, very few special flat glasses are now available at reasonable costs. Consequently, the special glass needed for the traditional flame sealing to metal cone alloys has become increasingly expensive and is available from only one source. The characteristics of Float glass are not very suitable for direct glass-to-metal sealing.

The "sealing" of a glass faceplate to a metal cone according to the prior art high temperature glass-to-metal seal method depends upon the ability of glass in the molten state to partially dissolve strongly adherent metallic oxides, thus forming a mechanically strong bond directly between the glass and metal. That sealing process, therefore, consists of oxidizing the metal, then melting the glass in contact with the oxidized metal and keeping the glass in the molten state until the bond is formed. The face plate and cone were placed in proximity to each other on a sealing machine, the face and cone were rotated and heated uniformly until the glass temperature was close to the annealing point (the temperature at which glass is fluid enough to allow stress relief without deforming). At that time, the sealing heat was applied at the edge of the faceplate and a lip of the cone, so that the faceplate glass in contact with metal was melted at a temperature of approximately 1000° C. and the seal was formed. Air pressure was controllably applied inside the cone during this operation to hold the faceplate in position and to work and form the seal. The shape of the seal was important, because a smooth contour eliminated points of high stress concentration in the seal area which might weaken the glass and cause glass breakage. At the completion of the sealing operation, the envelope was transferred to an oven maintained near the annealing temperature of the glass and allowed to temperature-equalize.

It is well known in the art that properly designed complex automatic or semi-automatic flame-sealing equipment can provide a fast and efficient means of producing high temperature glass-to-metal sealed metal and CRT envelopes. A most important factor in the flame sealing technique is "fire setting" and "running-in" of the sealing process; however, the fire setting and running-in steps invariably involve the initial production of rejects of scrap until successive small adjustments are made to provide the necessary quality and repeatability. Consequently, in the case of large CRT envelope assemblies, the flame-sealing technique is primarily suited to continuous production of large quantities. Since the current use of metal cone CRT's is limited to special radar displays and similar non-mass-produced products produced in small runs, the traditional flame sealing method of producing metal cone envelopes is extremely costly and inefficient.

The sealing of two glass surfaces, such as the edge of a glass CRT envelope body and a glass face panel, by use of a solder glass is well known. Such materials are either low melting point glasses or "frits", glass materials which change from a glassy state to a crystalline or ceramic state upon application of heat. Glass-to-glass seals using solder glasses are commonly employed to join glass faceplates to glass cones in the manufacture of shadow mask color CRT's. Such sealing materials have also been used for sealing relatively thick, small diameter glass or glass fiber-optic faceplates to metal envelopes of image intensifier tubes. See, for example, U.S. Pat. No. 3,916,240. In such tubes, the major sealing surface of the faceplate is parallel to the major plane of the faceplate and the faceplate thickness at the seal area is approximately 1/16 inch or more per inch of opening spanned by the faceplate.

To the best of my knowledge, however, solder glass seals have not been successfully used and have not been seriously considered suitable for sealing large, relatively thin glass faceplates to metal CRT cones. I have found that such seals can in fact be made in accordance with my invention, avoiding the high sealing temperatures, the critical control of the seal contour and the possible distortion of the faceplate which occurred in the prior, high temperature glass-to-metal sealing method. In accordance with my invention, it is unnecessary to use difficult to form chrome-bearing alloys and special glasses, and special treatment to enhance the oxides of the sealing area is unnecessary.

If one merely substitutes a solder glass seal at the interface of the large glass faceplate and metal cone, following a similar metal lip contour to that employed for flame sealed metal cone envelopes, the mechanical properties of the envelope are quite unsatisfactory. Such an envelope will not withstand a 35 pound per square inch absolute test, the minimum required to assure the safe processing and use of the CRT envelope. Thus, in accordance with the present invention, the shape of the interface between glass faceplate and metal cone differs from that of the earlier tubes mentioned above.

Further details concerning the objects and advantages of my method and apparatus will be clear from the drawings and the following detailed description.

DETAILED DESCRIPTION

Figure 1:
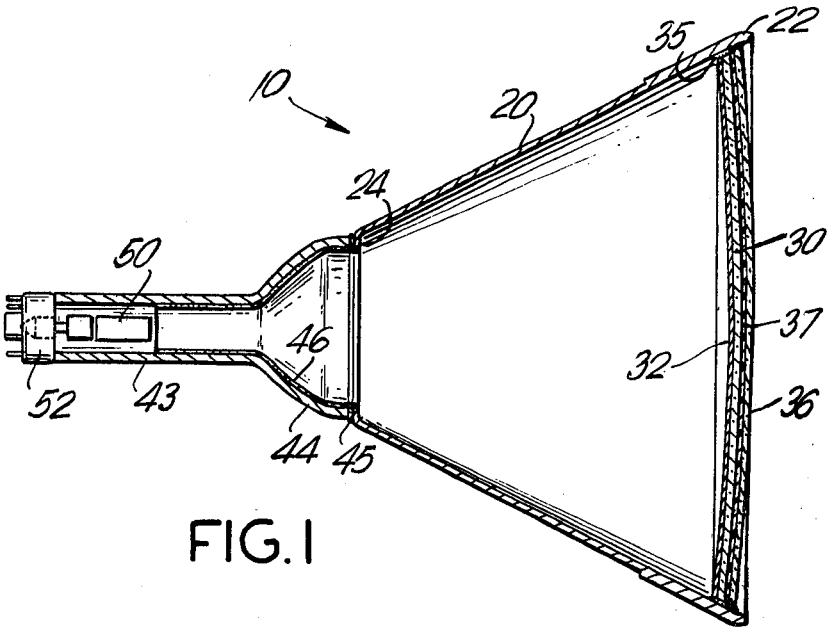
FIG. 1 is the cross-section of a cathode ray tube made in accordance with my invention.
Figure 2:
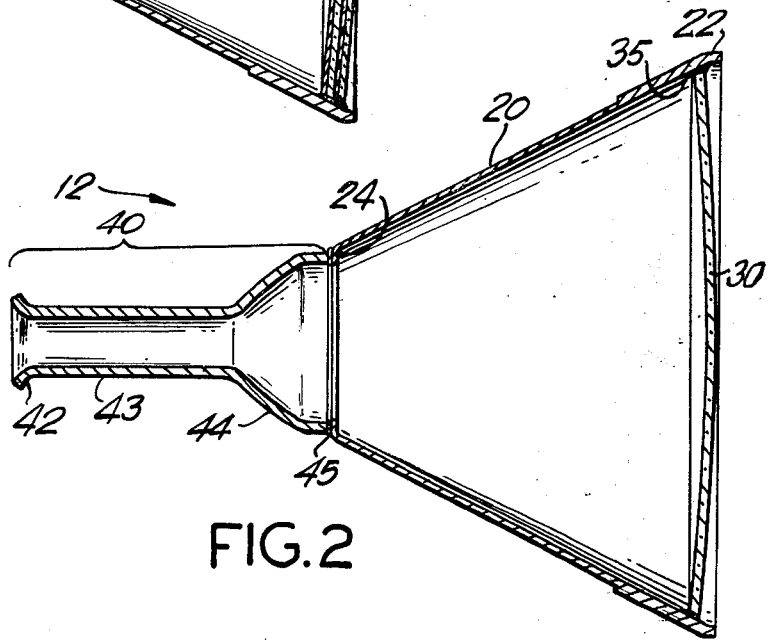
FIG. 2 is the cross-section of a cathode ray tube envelope made in accordance with my invention.

A large diameter cathode ray tube 10 and its envelope 12 are shown in FIGS. 1 and 2 respectively. The envelope 12 has three principal components: a metal cone 20, a curved faceplate 30 and a funnel neck assembly 40. This metal cone 20 has a faceplate support region 22 surrounding a large opening at one end and an inward turned neck flange 24 surrounding a smaller opening at the other end.

Figure 3:
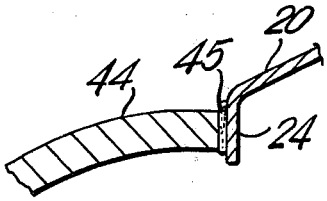
FIG. 3 is a detailed cross-section of the funnel neck seal area of the cathode ray tube envelope of FIGS. 1 and 2.

The neck assembly 40 has a tubular section 43, a flared end 42 to ease insertion of an electron gun 50 into the tubular neck section 43, and a bell-shaped transition section or funnel 44. The end of the transition section 44 in this embodiment is sealed to the neck flange 24 of the metal cone 20 by a layer of frit 35, as shown in greater detail in FIG. 3. In some embodiments, however, the transition section 44, is sealed directly to the neck flange 22 by a high temperature seal.

Figure 4:
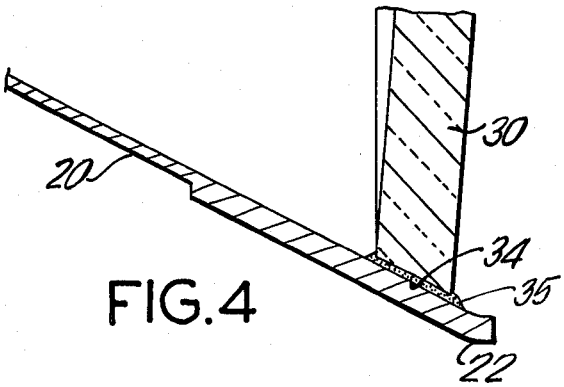
FIG. 4 is a detailed cross-section of the faceplate seal area of the cathode ray tube envelope of FIGS. 1 and 2.
Figure 5:
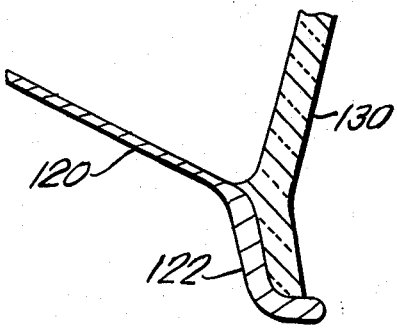
FIG. 5 (PRIOR ART)
FIG. 5 is a detailed cross-section of the faceplate seal area of a prior art, high temperature sealed metal cone cathode ray tube envelope.

The faceplate 30 is glass of substantially uniform thickness which has been formed into a convex curved surface. The ratio of faceplate diameter to faceplate thickness is approximately 41 to 1. The edge of the faceplate 30 is sealed to the faceplate support region 22 of the metal cone 20 by a layer of frit 35, as shown in more detail in FIG. 4, rather than by a direct high temperature, glass-to-metal seal as in the well known metal cone CRT envelopes of the prior art. See, for example, FIG. 5 which shows a cross-section of the glass-to-metal seal of a faceplate 130 to the lip 122 of the metal cone 120 of a type 16AP4 CRT of the prior art mentioned above.

The envelope 12 of FIG. 2 is made into the CRT 10 of FIG. 1 in conventional fashion. The resulting CRT 10 includes a phosphor screen 32 on the inside of the faceplate 30, an electron gun 50 inside the neck section 43, an internal conductive coating 46 on the neck and transition sections 43, 44, and a base 52 for electrical connections to the electron gun 50. In various embodiments of my invention, the electron beam produced by the electron gun 50 can be focused and deflected by internal electrostatic elements, or focused and deflected by internal or external magnetic components, or focused and deflected by a combination of electrostatic and magnetic components.

In one example of this embodiment of my invention, a 22 inch diameter CRT envelope was manufactured with a metal cone of Allegheney-Ludlum type AL 52 (51% nickel-iron alloy) which contains no chromium. This material has a coefficient of expansion of approximately $92\times10^{-7}$° C. In this case, the metal was annealed at 870° C. for 20 minutes in a hydrogen atmosphere to attain a Rockwell hardness of RB 75 max. The metal cone 20 is formed by spinning on a conical form from an annealed piece 0.160 thick and 23 inches on a side. The sidewall thickness of the completed cone was approximately 0.080 inches except in the faceplate support region 22 and the neck flange 24, where the approximate thicknesses were 0.120 inches and 0.125 inches respectively. The length of the faceplate support region 22 is 2½ inches in the example and is specified as not less than two inches. The included angle of the cone 20, including that of the faceplate support region 22, is approximately 62 degrees. Similar tubes have been made with a 53° angle cone and other angles are possible, however, I have found that the angle of the bevel at the edge of the faceplate and of the corresponding faceplate support region 22 must be 45° to the axis through the center of the faceplate 30 or less to produce marginally satisfactory pressure test results with ½ inch thickness faceplates, and preferably this angle should be 35° or less. Thus if the included angle of the cone is greater than about 70°, the faceplate support region should be turned inward to present a better sealing angle. Note that, unlike the prior art large metal cone cathode ray tubes mentioned above, my invention does not require a generally horizontal faceplate flange.

The faceplate 30 was formed to a spherical contour of approximately 150 inches by conventional controlled heat sagging. It was formed from a sheet of conventional Float glass having a nominal thickness of ½ inch. This type of conventional soda-lime glass, which is one of the most readily available today, has temperature characteristics which make it difficult to flame seal to either glass or metal. The faceplate was sealed to the cone in accordance with my invention without any significant deformation of the faceplate or change in its radius of curvature.

The coefficient of expansion of the faceplate material is approximately $88\times10^{-7}$° C. The slight differential between coefficients of expansion of the cone 20 and the faceplate 30 creates a favorable compression after the seal between them is made. The rim 34 of the faceplate 30 is beveled at an angle of 31 degrees to the axis through the center of the faceplate, matching the angle of the cone 20.

The funnel neck section 40 is made from Lancaster Glass Co. type LEA-12 glass, a potash-soda-lead composition having a coefficient of expansion of approximately $90\times10^{-7}$° C.

The steps of manufacturing this embodiment are as follows: not necessarily in the order listed except where specifically indicated.

A. Preparation Steps

1. Inspect glass faceplate 30 for quality and conformity to specifications. The glass must be free of internal bubbles and surface scratches.

2. Regrind bevel on faceplate rim 34, if necessary, and acid fortify it in conventional frit seal preparation fashion.

3. Inspect the funnel neck section 40 in similar fashion.

4. Grind and acid fortify the sealing region of the funnel neck 44 in conventional frit seal preparation fashion.

5. Inspect metal cone 20 for quality and conformity to specifications, with special attention to cleanliness, smoothness and roundness of sealing regions 22 and 24.

6. Sand blast the seal regions 22 and 24 of the metal cone 20 to remove any scale and lubricants.

7. Vapor degrease the metal cone 20 after sandblasting.

B. Funnel Neck Sealing

1. Apply frit to both the neck flange 24 of the metal cone 20 and the sealing region of the funnel neck assembly 40. Corning Glass Works type 89 Pyroceram frit (a lead containing frit) was used in this embodiment.

2. Using a fixture weighing approximately 6 pounds to hold the funnel neck 40 with the neck up in proper relation to the cone 20, the cone 20 and funnel neck 40 are placed in an electrically heated circulating air oven. A faceplate 30 may be placed in the large open end of the metal cone 20 to keep the cone 20 from distorting during sealing of the funnel neck assembly 40.

3. The frit sealing heat cycle used is as follows:

1.5° C./min to 350° C.,
6° C./min to 440° C.,
hold at 440° C. for 1 hour,
reduce at 1.5° C./min to 300° C., and
reduce at 6° C./min to room temperature.

C. Faceplate Sealing

1. Check fit of faceplate 30 to faceplate support region 22 of the metal cone 20.

2. Clean faceplate 30 thoroughly.

3. Apply frit evenly to the sealing edge of the faceplate rim 34, in a 0.080 inch strip, being sure to keep the faceplate dry and clean. The same covering type 89 Pyroceram frit is used.

4. After cleaning the faceplate support region 22, of the metal cone 20, place the faceplate 30 in position while holding the cone 20 vertical with the large end up.

5. Carefully level the edge of the faceplate 30 with respect to the edge of the cone 20.

6. Weight the faceplate 30 with six 3 pound weights evenly spaced about the periphery of the faceplate 30.

7. Using a fixture to hold the cone 20 upright and the faceplate 30 level, they are placed in the electrically heated oven and subjected to the frit sealing cycle as described in B. 3 above. In order to prevent tipping of the faceplate 30 during sealing, the sealing fixtures include a metal ring approximately ¾ the diameter of the faceplate 30. This ring is rigidly suspended over the faceplate by a spider from a rod which is coaxially with the ring but spaced from the plane of the ring. The ring bears lightly on asbestos pads on the faceplate 30 during sealing.

8. After cooling, inspect the completed envelope 12 for quality acceptance.

Following manufacturing of the envelope 12 in the manner described above, the CRT 10 was completed in conventional fashion with the application of a phosphor screen 32 inside the faceplate 30, application of internal conductive coatings 46, insertion of the electron gun 50, sealing, exhausting and application of the base 52. Following application of a conventional laminated safety panel 36, safety tests were conducted in accordance with Federal Aviation Administration specification FAA-E-2512. All of the tests were completed satisfactorily.

We claim:

1. A large cathode ray tube envelope comprising a metal truncated cone and a curved glass faceplate sealed to the large end of the cone, said faceplate comprising an inner surface and an outer surface, characterized by a beveled edge on the faceplate, said beveled edge comprising a substantially straight, radially, outwardly facing surface defining the outermost perimeter of said faceplate and joining the inner and outer surfaces of said faceplate, and a layer of solder glass between the beveled edge and the metal cone forming a hermetic seal between them, wherein the faceplate is supported solely by the beveled edge, and the angle of the bevel with respect to an axis through the center of the faceplate is substantially the same as the angle of the sealing zone of the metal cone and less than approximately 45°.

2. The envelope of claim 1 wherein the solder glass is a lead-containing frit.

3. The envelope of claim 1 wherein the metal cone is a substantially chromium free alloy primarily comprising iron and nickel.

4. The envelope of claim 1 wherein the wall of the cone extends inwardly from the edge of the faceplate at substantially that same angle for a distance substantially more than the thickness of the faceplate.

5. The envelope of claim 4 wherein the metal cone further comprises a reinforced section at its outer edge.

6. The envelope of claim 1 wherein the radius of the faceplate is approximately 150 inches.

7. The envelope of claim 6 wherein the faceplate comprises float glass.

8. The envelope of any of claims 1–3, and 4–5 and 7 wherein the ratio of the smallest dimension spanned by the faceplate to the faceplate thickness is in excess of 30.

9. The envelope of claim 8 further characterized by lack of distortion in the faceplate in the vicinity of the faceplate to cone seal area.

10. A large cathode ray tube comprising a glass funnel-neck section, an electron gun within the neck portion of the funnel-neck section, a metal transition section having a small opneing at one end and a large opening at the other end with the funnel portion of the funnel-neck section sealed to the small opening and a curved glass faceplate sealed to the large opening, said faceplate comprising an inner surface and an outer surface, characterized by a beveled edge on the faceplate said beveled edge comprising a substantially straight, radially, outwardly facing surface defining the outermost perimeter of said faceplate and joining the inner and outer surfaces of said faceplate, and a layer of solder glass between the beveled edge and the metal transition section forming a hermetic seal between them, wherein the faceplate is supported solely by the beveled edge, and the angle of the bevel with respect to an axis through the center of the faceplate is substantially the same as the angle of the sealing zone of the metal transition section and less than approximately 45°.

11. The large cathode ray tube of claim 10 wherein the solder glass is a lead-containing frit.

12. The large cathode ray tube of claim 10 wherein the metal cone is a substantially chromium free alloy primarily comprising iron and nickel.

13. The large cathode ray tube of claim 10 wherein the wall of the cone extends inwardly from the edge of the faceplate at substantially that same angle for a distance substantially more than the thickness of the faceplate.

14. The large cathode ray tube of claim 13 wherein the metal cone further comprises a reinforced section at its outer edge.

15. The large cathode ray tube of claim 10 wherein the radius of the faceplate is approximately 150 inches.

16. The large cathode ray tube of claim 15 wherein the faceplate comprises Float glass.

17. The large cathode ray tube of any of claims 10–12, 13–15 and 16 wherein the ratio of the smallest dimension spanned by the faceplate to the faceplate thickness is in excess of 30.

18. The large cathode ray tube 17 further characterized by lack of distortion in the faceplate in the vicinity of the faceplate to cone seal area.

* * * * *

UNITED STATES PATENT AND TRADEMARK OFFICE

CERTIFICATE OF CORRECTION

PATENT NO. : 4,432,464

DATED : February 21, 1984

INVENTOR(S) : Peter Seats et al.

It is certified that error appears in the above-identified patent and that said Letters Patent is hereby corrected as shown below:

Col. 5, line 67, "is coaxially" should be --is coaxial--.

Col. 6, line 56, "opneing" should be --opening--.

Col. 6, line 47, "1-3, and 4-5 and 7" should be --1-3, and 4-7--.

Col. 8, line 12, after "tube" insert --of claim--.

Signed and Sealed this

*Thirty-first* Day of *July 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,432,464

DATED : February 21, 1984

INVENTOR(S) : Peter Seats et al.

It is certified that error appears in the above-identified patent and that said Letters Patent are hereby corrected as shown below:

Claim 8, column 6, line 47, "1-3, and 4-5 and 7" should be --1-3, or 4-7--.

Claim 17, column 8, line 9, "10-12, 13-15 and 16" should be --10-15 or 16--.

Signed and Sealed this

First Day of January 1985

[SEAL]

*Attest:*

*Attesting Officer*

GERALD J. MOSSINGHOFF

*Commissioner of Patents and Trademarks*